US008041270B2

(12) United States Patent
Yasunaga et al.

(10) Patent No.: US 8,041,270 B2
(45) Date of Patent: Oct. 18, 2011

(54) IMAGE DEVELOPER USING ONE-COMPONENT DEVELOPER

(75) Inventors: Hideaki Yasunaga, Ibaraki (JP); Masayuki Hagi, Minoh (JP); Yoshihiro Mikuriya, Nishinomiya (JP); Hiroaki Katoh, Nagaokakyo (JP); Kazuoki Fuwa, Toyonaka (JP); Masahide Inoue, Numazu (JP); Yoshitaka Sekiguchi, Nishinomiya (JP); Satoshi Ogawa, Nara (JP)

(73) Assignee: Ricoh Company, Limited, Tokyo (JP)

( * ) Notice: Subject to any disclaimer, the term of this patent is extended or adjusted under 35 U.S.C. 154(b) by 854 days.

(21) Appl. No.: 12/048,865

(22) Filed: Mar. 14, 2008

(65) Prior Publication Data

US 2008/0226356 A1 Sep. 18, 2008

(30) Foreign Application Priority Data

Mar. 16, 2007 (JP) ..... 2007-067948

(51) Int. Cl.
*G03G 15/08* (2006.01)

(52) U.S. Cl. ..... 399/279; 399/286

(58) Field of Classification Search ..... 399/279, 399/286

See application file for complete search history.

(56) References Cited

U.S. PATENT DOCUMENTS

| | | | |
|---|---|---|---|
| 2006/0204882 | A1 | 9/2006 | Nozaki et al. |
| 2006/0210902 | A1 | 9/2006 | Nakamura et al. |
| 2006/0275686 | A1 | 12/2006 | Kadota et al. |
| 2006/0292474 | A1 | 12/2006 | Mikuriya et al. |
| 2007/0026335 | A1 | 2/2007 | Yamamoto et al. |
| 2007/0059625 | A1 | 3/2007 | Yamamoto et al. |
| 2007/0122729 | A1 | 5/2007 | Katoh et al. |
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0238042 | A1 | 10/2007 | Yasunaga et al. |
| 2008/0038656 | A1 | 2/2008 | Yasunaga et al. |

FOREIGN PATENT DOCUMENTS

| | | |
|---|---|---|
| JP | 10-319709 | 12/1998 |
| JP | 3054786 | 4/2000 |
| JP | 2001-51495 | 2/2001 |
| JP | 2006-99036 | 4/2006 |

OTHER PUBLICATIONS

U.S. Appl. No. 12/208,801, filed Sep. 11, 2008, Ogawa et al.
U.S. Appl. No. 12/241,656, filed Sep. 30, 2008, Yasunaga et al.

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

An image developer using a one-component developer, Including a developing roller visualizing an electrostatic latent image formed on an image bearer with a pulverized toner; and a feed roller feeding the pulverized toner to the developing roller while contacting thereto, wherein the pulverized toner includes a parent toner; a wax; and an external additive comprising an additive having a number-average particle diameter of from 20 to 60 nm and adhering to the surface of the parent toner at an adherence strength of from 50 to 70%, and wherein the following relationships (1) to (3) are satisfied:

$$4.70<\mathrm{Log}_{10}R<5.70 \quad (1)$$

$$8.00<\mathrm{Log}_{10}Z<10.70 \quad (2)$$

$$-6.25*\mathrm{Log}_{10}R+37.5<\mathrm{Log}_{10}Z<-6.25*\mathrm{Log}_{10}R+45.6 \quad (3)$$

wherein R represents a resistivity of the developing roller and Z represents an impedance of the pulverized toner.

7 Claims, 2 Drawing Sheets

IMAGE DEVELOPER USING ONE-COMPONENT DEVELOPER

BACKGROUND OF THE INVENTION

1. Field of the Invention

The present invention relates to an image developer suing a one-component developer, and more particularly to an image developer using a one-component developer developing an electrostatic latent image with a thin toner layer formed on a developing roller by pressing a toner thereon with a regulation blade.

2. Discussion of the Background

Conventional electrophotographic image forming methods include charging the surface of an image bearer (photoreceptor), irradiating the surface thereof to form an electrostatic latent image thereon, developing the electrostatic latent image with a colored toner to form a toner image thereon, transferring the toner image onto a receiving material such as a transfer paper, and fixing the toner image thereon.

Dry developing methods used in electrophotographic image forming methods and electrostatic recording methods include a method of using a two-component developer including a toner and a carrier, and a method of using a one-component developer not including a carrier. The former stably produces good images, but is difficult to produce constant-quality images for long periods because the carrier is easy to deteriorate and a mixing ratio of the toner to the carrier (toner concentration) is easy to vary. In addition, image forming apparatuses using the two-component developer are difficult to maintain and downsize. Therefore, the latter method of using the one-component developer is drawing attention.

The method of using the one-component developer typically feeds a toner (developer) with at least one toner transfer member and visualizes an electrostatic latent image formed on an image bearer with the toner. An amount of the toner on the toner transfer member is regulated by a toner layer thickness regulator located facing the toner transfer member, and the toner is charged when passing therethrough. Specific examples of thereof include various members such as a regulation blade. The regulation blade (a pressure member) is located facing the toner transfer member and presses the toner thereon to regulate the thickness of the toner layer. In addition, a roller instead of the blade is also widely used.

In the one-component developing method, the toner which has not been used in a developing area on the toner transfer member (a developing roller) is scraped by a toner feed member feeding a toner while contacting the toner transfer member, and is fed into a toner hopper again. However, when the adherence of the toner to the developing roller is large, the scrapability, i.e., the resettability deteriorates. Therefore, the toner on the developing roller increases, resulting in inability of stably charging and transferring the toner of the developing roller.

In order to solve this problem, various improvements are made to decrease the adherence between the developing roller and the toner.

Japanese published unexamined application No. 2006-99036 discloses an image developer regulating the resistivity of a developing roller to have good resettability. However, a relationship between the roller resistivity and an impedance of a toner is not regulated, charging and resetting are not well balanced, resulting in production of unstable-quality images.

Since a toner receives and leaves a charge contacting various members in image forming processes such as a stirring process, the measurement of a toner impedance against an AC voltage enables measurement of electrical properties of the toner moving the toner in an image forming apparatus. Particularly, in order to improve the resettability, the control of the impedance against an AC voltage is indispensable for production of stable-quality images because the electrical properties of a toner from the measurement of the toner impedance largely contribute thereto.

Japanese published unexamined application No. 2001-51495 discloses an image developer including a developing roller preferably having a resistivity of from $10\times10^2$ to $10\times10^8$. However, a relationship between the roller resistivity and an impedance of a toner is not regulated, charging and resetting are not well balanced, resulting in production of unstable-quality images as it is in the above-mentioned Japanese published unexamined application No. 2006-99036.

Further, Japanese published unexamined application No. 10-319709 discloses an image developer, wherein charging and resetting are not well balanced, either.

Furthermore, since adherence of an external additive to a parent toner has not conventionally regulated, a non-electrostatic adherence of a toner to a developing roller has not been controlled, resulting in occasional insufficient resettability of the toner. An external additive easily fixable on a parent toner and difficult to bury therein is necessary to control the non-electrostatic adherence of a toner so as to have stable resettability including durability.

Because of these reasons, a need exists for an image developer using one-component developer producing images not having uneven image density due to poor toner resettability and producing stable-quality images.

SUMMARY OF THE INVENTION

Accordingly, an object of the present invention is to provide an image developer using a one-component developer producing images not having uneven image density due to poor toner resettability and producing stable-quality images.

Another object of the present invention is to provide a process cartridge using the image developer.

A further object of the present invention is to provide an image forming apparatus using the image developer.

These objects and other objects of the present invention, either individually or collectively, have been satisfied by the discovery of an image developer using a one-component developer, comprising:

a developing roller configured to visualize an electrostatic latent image formed on an image bearer with a pulverized toner; and a feed roller configured to feed the pulverized toner to the developing roller while contacting thereto, wherein the pulverized toner comprises:

a parent toner;

a wax; and an external additive comprising an additive having a number-average particle diameter of from 20 to 60 nm and adhering to the surface of the parent toner at an adherence strength of from 50 to 70%, and wherein the following relationships (1) to (3) are satisfied:

$$4.70<\mathrm{Log}_{10}R<5.70 \quad (1)$$

$$8.00<\mathrm{Log}_{10}Z<10.70 \quad (2)$$

$$-6.25*\mathrm{Log}_{10}R+37.5<\mathrm{Log}_{10}Z<-6.25*\mathrm{Log}_{10}R+45.6 \quad (3)$$

wherein R represents a resistivity of the developing roller and Z represents an impedance of the pulverized toner.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
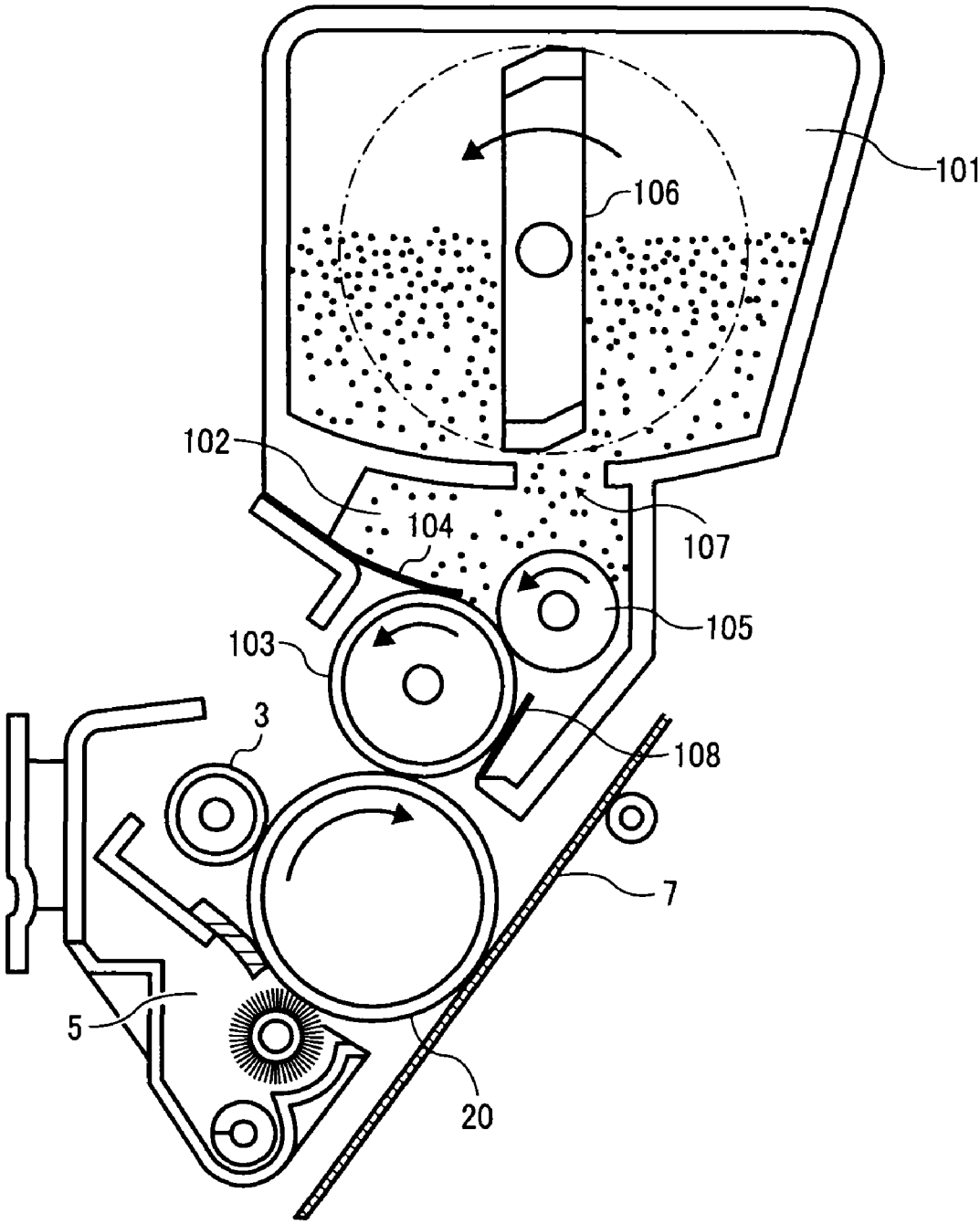
FIG. 1 is a schematic view partially illustrating a cross-section of an embodiment of the image developer using a one-component developer of the present invention.

The present invention provides an image developer using one-component developer producing images not having uneven image density due to poor toner resettability and producing stable-quality images.

More particularly, the present invention relates to an image developer using a one-component developer, comprising:

a developing roller configured to visualize an electrostatic latent image formed on an image bearer with a pulverized toner; and a feed roller configured to feed the pulverized toner to the developing roller while contacting thereto, wherein the pulverized toner comprises:

a parent toner;

a wax; and an external additive comprising an additive having a number-average particle diameter of from 20 to 60 nm and adhering to the surface of the parent toner at an adherence strength of from 50 to 70%, and wherein the following relationships (1) to (3) are satisfied:

$$4.70<\mathrm{Log}_{10}R<5.70 \quad (1)$$

$$8.00<\mathrm{Log}_{10}Z<10.70 \quad (2)$$

$$-6.25*\mathrm{Log}_{10}R+37.5<\mathrm{Log}_{10}Z<-6.25*\mathrm{Log}_{10}R+45.6 \quad (3)$$

wherein R represents a resistivity of the developing roller and Z represents an impedance of the pulverized toner.

FIG. 1 is a schematic view illustrating a cross-section of an embodiment of the image developer using a one-component developer of the present invention.

The image developer includes a toner containing room (101), a toner feeding room (102) located below the toner containing room (101), a developing roller (103) below the toner feeding room (102), a layer regulation member (104) located contacting the developing roller (103) and a feed roller (105). The developing roller (103) is located contacting a photoreceptor drum (20) and is applied with a predetermined developing bias from a high-voltage electric source (not shown). The toner containing room (101) includes a toner stirring member (106) rotating anticlockwise. The toner stirring member (106) has a larger area at a part not passing near an opening (107) in the axial direction, and fully fluidizes and stirs a toner in the toner containing room (101). The toner stirring member (106) has a smaller area at a part passing near the opening (107) and prevents an excessive amount of the toner from leading thereto. The toner near the opening (107) is adequately stirred by the toner stirring member, passes through the opening (107) and falls into the toner feeding room (102) under its own weight. The surface of the feed roller (105) is coated with a foamed material having cells, efficiently absorbs the toner fallen into toner feeding room (102) and prevents the toner from deteriorating due to concentration of pressure at a contact point with the developing roller (103). The foamed material has an electrical resistivity of from $10^3$ to $10^{14}$ Ω·cm. The feed roller (105) is applied with a feed bias offset in the same direction of the charge polarity of the toner against the developing bias. The feed bias presses the preliminarily-charged toner toward the developing roller (103) at a contact point therewith. However, the offset direction is not limited thereto, the offset may be zero or the offset direction may be changed depending upon the toner. The feed roller (105) rotates anticlockwise and feeds the toner adhering to the surface thereof to the surface of the developing roller (103) like coating. The developing roller (103) is coated with an elastic rubber layer and further coated with a surface layer formed of a material easily chargeable to have a polarity reverse to that of the toner. The elastic rubber layer has a hardness not greater than 60° when measured by JIS-A to prevent the toner from deteriorating due to concentration of pressure at a contact point with the layer regulation member (104). The elastic rubber layer has a surface roughness Ra of from 0.3 to 2.0 μm and holds a required amount of the toner at the surface thereof. The developing roller (103) rotates anticlockwise and transfers the toner held at the surface thereof to the layer regulation member (104) and to a position facing the photoreceptor drum (20). The layer regulation member (104) is located at a position lower than the contact point between the feed roller (105) and the developing roller (103), and is a metallic plate spring material formed of SUS, phosphor bronze, etc. The layer regulation member (104) contacts its free end to the surface of the developing roller (103) at a pressure of from 10 to 40 N/m, and thins a layer of the toner and frictionally charges the toner. Further, the layer regulation member (104) is applied with a regulation bias offset in the same direction of the charge polarity of the toner against the developing bias to assist when frictionally charging the toner. The photoreceptor drum (20) rotates clockwise, and therefore the surface of the developing roller (103) travels in the same direction of the traveling direction of the photoreceptor drum (20) at a position facing the photoreceptor drum (20). The thinned layer of the toner is transferred to the position facing the photoreceptor drum (20) and to the surface thereof to develop an electrostatic latent image according to the developing bias applied to the developing roller (103) and a latent image electric field formed by the electrostatic latent image. At a position where the toner remaining untransferred on the developing roller (103) returns into the toner feeding room (102), a seal (108) is located contacting the developing roller (103) to prevent the toner form leaking out of the image developer.

The process cartridge of the present invention includes a photoreceptor bearing an electrostatic latent image, the image developer and at least one of a charger and a cleaner.

The image forming apparatus of the present invention includes a photoreceptor; a charger charging the photoreceptor to form an electrostatic latent image thereon; the image developer developing the electrostatic latent image with a developer comprising a toner to form a toner image on the photoreceptor; a transferer transferring the toner image onto a transfer sheet; a fixer fixing the toner image on the transfer sheet; and a cleaner cleaning the photoreceptor to remove the toner remaining thereon.

The elastic rubbers on the surface of the developing roller are not particularly limited and include, e.g., a styrene-butadiene copolymer rubber, an acrylonitrile-butadiene copolymer rubber, an acrylic rubber, an epichlorohydrin rubber, a urethane rubber, a silicon rubber, their mixtures, etc. Among these rubbers, a blend rubber including the epichlorohydrin rubber and the crylonitrile-butadiene copolymer rubber is preferably used.

The elastic rubber may include a conductivizer such as carbon black, and an amount thereof is controlled to adjust the resistivity of the developing roller.

The developing roller for use in the present invention is produced by coating an elastic rubber on the outer circumference of an electroconductive shaft. The electroconductive shaft is formed of metals such as stainless.

The present invention is an image developer using a one-component developer, comprising:

a developing roller configured to visualize an electrostatic latent image formed on an image bearer with a pulverized toner comprising a wax; and a feed roller configured to feed the pulverized toner to the developing roller while contacting thereto, wherein the pulverized toner comprises:

a parent toner; and an external additive comprising an additive having anumber-average particle diameter of from 20 to 60 nm and adhering to the surface of the parent toner at an adherence strength of from 50 to 70%, and wherein the following relationships (1) to (3) are satisfied:

$$4.70<\mathrm{Log}_{10}R<5.70 \quad (1)$$

$$8.00<\mathrm{Log}_{10}Z<10.70 \quad (2)$$

$$-6.25*\mathrm{Log}_{10}R+37.5<\mathrm{Log}_{10}Z<-6.25*\mathrm{Log}_{10}R+45.6 \quad (3)$$

wherein R represents a resistivity of the developing roller and Z represents an impedance of the pulverized toner.

When $\mathrm{Log}_{10}R$ is 4.70 or less, the developing roller has low resistivity and charge quantity of the toner decreases, resulting in shortage of electrostatic adherence between the toner and the developing roller and inability of forming a thin layer of the toner on the developing roller. When $\mathrm{Log}_{10}R$ is 5.70 or more, the developing roller has high resistivity and charge quantity of the toner increases, resulting in an excessive electrostatic adherence between the toner and the developing roller and deterioration of the toner resettability on the developing roller.

When $\mathrm{Log}_{10}Z$ is 8.00 or less, the toner impedance is low and charge quantity of the toner decreases, resulting in shortage of electrostatic adherence between the toner and the developing roller and inability of forming a thin layer of the toner on the developing roller. When $\mathrm{Log}_{10}Z$ is 10.70 or more, the toner impedance is high and charge quantity of the toner increases, resulting in an excessive electrostatic adherence between the toner and the developing roller and deterioration of the toner resettability on the developing roller.

Further, when $\mathrm{Log}_{10}Z$ is $-6.25*\mathrm{Log}_{10}R+37.5$ or less, the charge quantity of the toner decreases, resulting in shortage of electrostatic adherence between the toner and the developing roller and inability of forming a thin layer of the toner on the developing roller. When $\mathrm{Log}_{10}Z$ is $-6.25*\mathrm{Log}_{10}R+45.6$ or more, the toner impedance is high and charge quantity of the toner increases, resulting in an excessive electrostatic adherence between the toner and the developing roller and deterioration of the toner resettability on the developing roller.

The toner impedance and the resistivity of the developing roller satisfying the above-mentioned relationships stabilize a feed amount of the toner by resetting the thin layer of the toner formed after passing through the regulation member with a feed roller to stabilize the charge quantity of the toner.

When the external additive has a particle diameter less than 30 nm, it does not fully perform a spacer effect and the parent toner contacts the developing roller, resulting in an excessive non-electrostatic adherence of the toner and deterioration of the resettability thereof on the developing roller. When greater than 60 nm, although having a spacer effect, the external additive is difficult to fix on the parent toner and left therefrom due to a stress in the image developer, resulting in being equivalent to a toner without an external additive.

When the external additive has an adherence strength less than 50%, it is not fully fixed on the parent toner and left therefrom due to a stress in the image developer, resulting in being equivalent to a toner without an external additive. The parent toner contacts the developing roller and an excessive non-electrostatic adherence of the toner causes deterioration of the resettability thereof on the developing roller. When greater than 70%, the external additive is buried in the parent toner and it does not fully perform a spacer effect and the parent toner contacts the developing roller, resulting in an excessive non-electrostatic adherence of the toner and deterioration of the resettability thereof on the developing roller.

In the present invention, an external additive having a number-average particle diameter of from 30 to 60 nm performs a spacer effect for the parent toner and gives fluidity thereto. The external additive having a number-average particle diameter of from 30 to 60 nm is preferably combined with an external additive having a number-average particle diameter less than 30 nm and/or an external additive having a number-average particle diameter greater than 60 nm to have a larger effect.

Since the external additive having a number-average particle diameter less than 30 nm noticeably improves the fluidity of a toner, an amount thereof is increased when the fluidity of a toner is needed.

Since the external additive having a number-average particle diameter greater than 60 nm noticeably improves the durability of a toner as a spacer, an amount thereof is increased when the durability of a toner is needed.

The amounts of the external additive having a number-average particle diameter less than 30 nm and the external additive having a number-average particle diameter greater than 60 nm can properly designed in accordance with the purpose.

The toner for use in the present invention preferably has a volume-average particle diameter of from 6 to 10 μm, and a shape factor of from 0.900 to 0.930. When less tan 6 μm, the toner has quite high adherence, resulting in large deterioration of the resettability. When greater than 10 μm, the resultant halftone image quality largely deteriorates. When the shape factor is less than 0.900, the resultant halftone image quality largely deteriorates also. An oilless pulverized toner having a shape factor larger than 0.930 is substantially difficult to produce.

When the toner includes silica in an amount less than 2.0% by weight as an external additive, the parent toner is not fully coated therewith, and the parent toners or the parent toner and the external additive contact each other, causing quite high adherence of the toner, resulting in large deterioration of the resettability thereof. When greater than 5.0% by weight, many of the external additives leave from the toner, resulting in noises on the resultant images and deterioration of the fixability of the toner.

When the toner includes a wax in an amount less than 3.0% by weight, the toner cannot be used in an oilless fixing system. When greater than 7.0% by weight, the wax has a larger dispersion diameter and the toner adheres to the layer regulation member, resulting in inability of being used as a one-component developer.

The parent toner for use in the present invention includes a binder resin and a colorant, and may include other additives. In the present invention, after a colorant, a charge controlling agent, a release agent, etc. are uniformly dispersed in a thermoplastic resin as a binder resin to prepare a toner constituent, the toner constituent is pulverized and classified to prepare a parent toner.

The binder resins are not limited, and may be known resins such as polyester resins, (meth)acrylic resins, styrene-(meth) acrylic copolymer resins, epoxy resins and cyclic olefin resins, e.g., TOPAS-COC from Ticona. The polyester resins are preferably used in terms of stress resistance in an image developer.

The polyester resin is typically formed by polycondensation between a polyol and a polycarboxylic acid. Specific examples of diols in the polyols include adducts of a bisphenol A such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane; ethylene glycol; diethylene glycol; triethylene glycol; 1,2-propylene glycol; 1,3-propylene glycol; 1,4-butadieneol; neo-pentyl glycol; 1,4-butenediol; 1,5-pentanediol; 1,6-hexanediol; 1,4-cyclohexanedimethanol; dipropyleneglycol; polyethyleneglycol; polytetramethyleneglycol; bisphenol A; hydrogenated bisphenol A; etc. Specific examples of tri- or more valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc.

Specific examples of dicarboxylic acids in the polycarboxylic acids include a maleic acid, a fumaric acid, a citraconic acids, an itaconic acid, a glutaconic acid, a phthalic acid, an isophthalic acid, a terephthalic acid, a cyclohexane dicarboxylic acid, a succinic acid, an adipic acid, a sebacic acid, an azelaic acid, a malonic acid, a n-dodecenylsuccinic acid, an isododecenylsuccinic acid, a n-dodecylsuccinic acids, an isododecylsuccinic acid, a n-octenylsuccinic acid, an isooctenylsuccinic acid, a n-octylsuccinic acid, an isooctylsuccinic acid, their anhydrides or lower alkyl esters, etc.

Specific examples of tricarboxylic acids include a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra(methylenecarboxyl)methane, a 1,2,7,8-octantetracarboxylic acid, an empol trimer acid, and their anhydrides and lower alkyl esters, etc.

In the present invention, a vinyl polyester resin is preferably used, which is prepared by a combination of a polycondensation reaction forming a polyester resin and a radical polymerization reaction forming a vinyl resin in a same container, using a mixture of a polyester resin material monomer, a vinyl resin material monomer and a monomer reacting with the both material monomers. The monomer reacting with the both material monomers is, i.e., a monomer usable in both of the polycondensation reaction and radical polymerization reaction. Namely, the monomer is a monomer having a polycondensation-reactable carboxyl group and a radical-polymerization-reactable vinyl group such as a fumaric acid, a maleic avid, an acrylic acid and a methacrylic acid.

The polyester resin material monomer includes the above-mentioned polyols and polycarboxylic acids. The vinyl material monomer includes styrenes or their derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins such as ethylene, propylene, butylene and isobutylene; methacrylate alkyl esters such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylate alkyl esters such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate and dodecylacrylate; unsaturated carboxylic acids such as an acrylic acid, a methacrylic acid, an itaconic acid and a maleic acid; acrylonitrile; maleate ester; itaconate ester; vinylchloride; vinylacetate; vinylbenzoate; vinylmethylethylketone; vinylhexylketone; vinylmethylether; vinylethylether; vinylisobutylether; etc. Specific examples of a polymerization initiator for polymerizing the vinyl resin material monomer include azo or diazo polymerization initiators such as 2,2'-azobis(2,4-dimethylvaleronitrile), 2,2'-isobutyronitrile, 1,1'-azobis(cyclohexane-1-carbonitrile) and 2,2'-azobis-4-methoxy-2,4-dimethylvaleronitrile; and peroxide polymerization initiators such as benzoylperoxide, dicumylperoxide, methylethylketoneperoxide, isopropylperoxycarbonate and lauroylperoxide.

The above-mentioned polyester resins are preferably used as a binder resin, and the following first and second binder resins are more preferably used in terms of improving the separativeness and offset resistance of the resultant oilless-fixing toner.

The first binder resin is a polyester resin prepared by polycondensating an adduct of bisphenol A with alkyleneoxide as the polyol, and a terephthalic acid and a fumaric acid as the polycarboxylic acid.

The second binder resin is a vinyl polyester resin prepared by using an adduct of bisphenol A with alkyleneoxide, a terephthalic acid, a trimellitic acid and a succinic acid as the polyester resin material monomer; styrene and butylacrylate as the vinyl resin material monomer; and a fumaric acid as the monomer reactive with both of the material monomers.

The first binder resin includes a hydrocarbon wax as mentioned above. In order to include a hydrocarbon wax in the first binder resin, the hydrocarbon wax is included in monomers forming the first binder resin when synthesized. For example, the hydrocarbon wax is included in an acid monomer and an alcohol monomer forming a polyester resin as the first binder resin, and the acid monomer and alcohol monomer are polycondensated. When the first binder resin is a vinyl polyester resin, the hydrocarbon wax is included in a polyester resin material monomer and a vinyl resin material monomer is dropped therein while stirred and heated to perform a polycondensation reaction and a radical polymerization reaction.

Typically, the lower the polarity of a wax, the better the releasability thereof from a fixing member (roller). The wax for use in the present invention is a hydrocarbon wax having a low polarity.

The hydrocarbon wax is a wax formed of only a carbon atom and a hydrogen atom, and does not include an ester group, an alcohol group or an amide group. Specific examples of the hydrocarbon wax include polyolefin waxes such as polyethylene, polypropylene and a copolymer between ethylene and propylene; petroleum waxes such as a paraffin wax and a microcrystalline wax; and synthetic waxes such as a Fischer-Tropsh wax. In the present invention, the polyethylene wax, the paraffin wax and the Fischer-Tropsh wax are preferably used, and the polyethylene wax and the paraffin wax are more preferably used.

In the present invention, the melting point of the wax is an endothermic peak thereof, which is measured with a differential scanning calorimeter when heated, and is preferably from 70 to 90° C. When higher than 90° C., the wax insufficiently melts in the fixing process and the resultant toner does not have sufficient separativeness. When lower than 70° C., the resultant toner has a problem of storage stability because the toner particles melt and are bonded with each other in an environment of high-temperature and humidity. The wax more preferably has a melting point of from 70 to 85° C., and furthermore preferably from 70 to 80° C. such that the resultant toner has sufficient separativeness.

The wax preferably has a half-value width of the endothermic peak not greater than 7° C., which is measured with a differential scanning calorimeter when heated. The wax in the present invention comparatively has a low melting point and a broad endothermic peak. Namely, a wax melting at a low temperature adversely affects the storage stability of the resultant toner.

The first binder resin (including a wax) and the second binder resin in a toner preferably have a weight ratio of from 20/80 to 45/55, and more preferably from 30/70 to 40/60. When the first binder resin has too low a weight ratio, the separativeness and hot offset resistance of the resultant toner deteriorate. When the first binder resin has too high a weight ratio, the glossiness and thermostable storage stability of the resultant toner deteriorate.

The binder resin formed of the first binder resin and the second binder resin preferably has a softening point of from 100 to 125° C., and more preferably from 105 to 125° C. In the present invention, the binder resin formed of the first binder resin including a wax and the second binder resin has the above-mentioned range of a softening point.

The first binder resin including a wax preferably has an acid value of from 5 to 50 KOH mg/g, and more preferably from 10 to 40 KOH mg/g. The second binder resin preferably has an acid value of from 0 to 10 KOH mg/g, and more preferably from 1 to 5 KOH mg/g. Particularly, polyester resins having such acid values improve dispersibilities of colorants and form a toner having good chargeability.

The first binder resin including a wax preferably includes a tetrahydrofuran (THF)-insoluble component in an amount of from 0.1 to 15% by weight, more preferably from 0.2 to 10% by weight, and furthermore preferably from 0.3 to 5% by weight in terms of hot offset resistance.

Known colorants conventionally used in full color toners can be used in the toner of the present invention. Specific examples of the colorant include carbon black, Aniline Blue, calcoil blue, chrome yellow, ultramarine blue, Dupont Oil Red, QUINOLINE YELLOW, Methylene blue-chloride, Copper Phthalocyanine, Malachite Green Oxalate, lampblack, Rose Bengal, C.I. Pigment Red 48:1, C.I. Pigment Red 122, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1, C.I. Pigment Blue 15:3, etc. The toner preferably includes the colorant in an amount of from 2 to 15 parts by weight per 100 parts by weight of all the binder resin. The colorant is preferably dispersed in a mixed binder resin of the first and second binder resins in the form of a masterbatch. The masterbatch preferably includes the colorant in an amount of from 20 to 40 parts by weight.

Known charge controlling agents conventionally used in full color toners can be used.

Specific examples thereof include Nigrosine dyes, triphenylmethane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor and its compounds, tungsten and its compounds, fluorine-containing activators, metal salts of salicylic acid, metal salts of salicylic acid derivatives, etc. Specific examples of marketed charge controlling agents include BONTRON P-51 (quaternary ammonium salt), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc. Particularly, a charge controlling agent controlling a toner so as to have a negative polarity is preferably used.

The content of the charge controlling agent in the toner is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

In the present invention, the toner impedance can be adjusted by controlling the content of the charge controlling agent.

In the present invention, other inorganic particulate materials besides silica can be used as external additives to support the fluidity and developability of the resultant toner.

Specific examples of the inorganic particulate material include silicon oxide, zinc oxide, tin oxide, quartz sand, titanium oxide, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In the present invention, the toner impedance can be adjusted by controlling the content of the external additives. Particularly, low-resistivity additives such as titania and alumina effectively adjust the toner impedance. Further, the external additive and other additives can be included in a toner to control the toner impedance.

The toner of the present invention can be prepared by mixing the first binder resin including a hydrocarbon wax, the second binder resin and the colorant to prepare a mixture; kneading the mixture to prepare a kneaded mixture; cooling the kneaded mixture to prepare a hardened mixture; pulverizing the hardened mixture to prepare a pulverized mixture; classifying the pulverized mixture to prepare a colored particulate resin having a desired particle diameter; and mixing the colored particulate resin with an external additive.

Known methods are used for the mixing, kneading, pulverizing classifying and mixing process.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 5 and Comparative Examples 1 to 10

[Preparation of the First Binder Resin]

600 g of styrene, 110 g of butylacrylate, 30 g of acrylic acid as vinyl monomers and 30 g of dicumylperoxide as a polymerization initiator were placed in a dripping funnel to prepare a mixed liquid. 1,230 g of polyoxypropylene (2,2)-2,2-bis(4-hydroxyphenyl)propane, 290 g of polyoxyethylene(2,2)-2,2-bis(4-hydroxyphenyl)propane, 250 g of isododecenylsuccinicanhydride, 310 g of terephthalic acid and 180 g of 1,2,4-benznetricarbonateanhydride as polyol; and 7 g of dibutyltinoxide as an esterification catalyst were mixed to prepare a polyester monomer. 4 parts by weight of paraffin wax having a melting point of 73.3° C. and a half-value width of the endothermic peak of 4° C. when measured with a differential scanning calorimeter and 100 parts by weight of the polyester monomer were placed in a 5-litter four-neck flask having a thermometer, a stainless stirrer, a falling condenser and a nitrogen inlet tube to prepare a mixture. The mixed liquid including the vinyl monomers and polymerization initiator was dropped for 1 hr in flask under a nitrogen atmosphere in a mantle heater at 160° C. while the mixture therein was stirred. After an addition polymerization was continued for 2 hrs at 160° C., a condensation polymerization was performed at 230° C. The polymerization degree was traced by a softening point measured with a constant-load extrusion capillary rheometer, and the reaction was finished when the resultant resin H1 had a desired softening point of 130° C.

[Preparation of the Second Binder Resin]

2,210 g of polyoxypropylene(2,2)-2,2-bis(4-hydroxyphenyl)propane, 850 g of terephthalic acid and 120 g of 1,2,4-benznetricarbonateanhydride as polyol; and 0.5 g of dibutyltinoxide as an esterification catalyst were placed in a 5-litter four-neck flask having a thermometer, a stainless stirrer, a falling condenser and a nitrogen inlet tube and subjected to a condensation polymerization under a nitrogen atmosphere in a mantle heater at 230° C. The polymerization degree was traced by a softening point measured with a constant-load extrusion capillary rheometer, and the reaction was finished when the resultant resin L1 had a desired softening point of 115° C.

[Preparation of Toner Particles]

After a masterbatch containing 100 parts by weight of a binder resin including 111 by ratio of the first binder resin and 100 by ratio of the second binder resin, 1.75 parts of a charge controlling agent LR-147 from Nippon Carlit Co., Ltd. and 4 parts by weight of a colorant C.I. Pigment Red 57-1 as a charge controlling agent (CCA) were fully mixed in a HENSCHEL MIXER to prepare a mixture, the mixture was melted and kneaded in a biaxial extruder PCM-30 from Ikegai Corp. to prepare a kneaded mixture. After the kneaded mixture was extended upon application of pressure with a cooling press roller to have a thickness of 2 mm and cooled with a cooling belt to prepare a hardened mixture, the hardened mixture was crushed with a feather mill to prepare a crushed mixture. Then, the crushed mixture was pulverized with a mechanical pulverizer KTM from Kawasaki Heavy Industries, Ltd. to have a volume-average particle diameter of from 10 to 12 μm and further pulverized with a jet pulverizer IDS from Nippon Pneumatic Mfg. Co., Ltd. to prepare a pulverized mixture. The pulverized mixture was classified with a rotor classifier 100ATP from Hosokawa Micron Group to prepare a colored particulate resin 1. The colored particulate resin 1 had a particle diameter of 7.5 μm. The procedure for preparation of the colored particulate resin 1 was repeated to prepare colored particulate resins 2 to 11 except for the content of the CCA and the rotation number of classifying.

An inorganic particulate material was added to 100 parts of the colored particulate resin in an amount shown in Table 1, and the mixture was mixed in HENSCHEL MIXER to prepare magenta toner particles 1. Silica 1 is RX50 having a primary particle diameter of 40 nm from Nippon Aerosil Co., Ltd., and silica 2 is R972 having a primary particle diameter of 16 nm therefrom.

The procedure for preparation of the magenta toner particles 1 was repeated to prepare magenta toner particles 2 to 15 except for using the colored particulate resins 2 to 11 (Toners for Examples 1 to 5 and Comparative Examples 1 to 10) and changing the content of the CCA, conductivizer, additive and conditions of mixing as shown in Table 1.

TABLE 1

| | CCA | Silica 1 | Silica 2 | Mixing conditions | Conductivizer |
|---|---|---|---|---|---|
| Colored particulate resin 1 | 1.75 | 2 | 1 | 40 m/s for 15 min | 35 |
| Colored particulate resin 2 | 1.90 | 2 | 1 | 40 m/s for 15 min | 30 |
| Colored particulate resin 3 | 1.00 | 2 | 1 | 40 m/s for 15 min | 32 |
| Colored particulate resin 4 | 1.10 | 2 | 1 | 40 m/s for 15 min | 39 |
| Colored particulate resin 5 | 2.00 | 2 | 1 | 40 m/s for 15 min | 37 |
| Colored particulate resin 6 | 1.20 | 2 | 1 | 40 m/s for 15 min | 40 |
| Colored particulate resin 7 | 2.40 | 2 | 1 | 40 m/s for 15 min | 35 |
| Colored particulate resin 8 | 0.75 | 2 | 1 | 40 m/s for 15 min | 35 |
| Colored particulate resin 9 | 1.75 | 2 | 1 | 40 m/s for 15 min | 24 |
| Colored particulate resin 10 | 1.10 | 2 | 1 | 40 m/s for 15 min | 27 |
| Colored | 2.2 | 2 | 1 | 40 m/s for | 38 |

TABLE 1-continued

| | CCA | Silica 1 | Silica 2 | Mixing conditions | Conductivizer |
|---|---|---|---|---|---|
| particulate resin 11 | | | | 15 min | |
| Colored particulate resin 2 | 1.90 | 3.5 | 1.7 | 40 m/s for 15 min | 30 |
| Colored particulate resin 2 | 1.90 | 2 | 1 | 40 m/s for 15 min | 30 |
| Colored particulate resin 2 | 1.90 | 2 | 1 | 40 m/s for 15 min | 30 |
| Colored particulate resin 2 | 1.90 | 1 | 0.8 | 30 m/s for 5 min | 30 |

Figure 2:
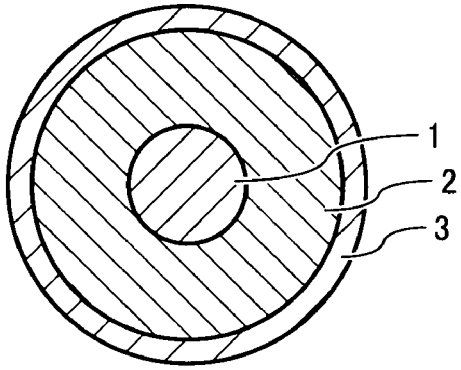
FIG. 2 is a schematic view illustrating a cross-section of a constitutional embodiment of a developing roller of the image developer using a one-component developer of the present invention.

The developing roller of the present invention includes, e.g., a shaft 1, a base rubber layer 2 formed on an outer circumference of the shaft 1 and a coated layer 3 formed on an outer circumference of the base rubber layer 2 as shown in FIG. 2. The developing roller may further includes an outermost surface layer as a charge layer.

The shaft 1 is not particularly limited, and e.g., a metallic shaft or a metallic hollow cylinder is used. Specific examples of the metals include aluminum, stainless, etc. Main components of the base rubber layer 2 formed on an outer circumference of the shaft 1 includes, e.g., a silicone rubber, etc. This is not particularly limited, but a vinyl-group-crosslinked dimethylsilicone polymer including a dimethylsilicone oil is preferably used.

The base rubber layer 2 may include a conductivizer such as carbon black in addition to the silicone rubber.

The coated layer 3 formed on an outer circumference of the base rubber layer 2 includes a rubber composition including a rubber material (A) and a specific silane coupling agent (B).

Specific examples of the rubber material (A) are not particularly limited unless they are hydrogenated acrylonitrile-butadiene rubbers and fluorine-containing rubbers, and include rubbers such as an acrylonitrile-butadiene rubber (NBR), an acrylic rubber (ACM), a butadiene rubber (BR), an isoprene rubber (IR), a styrene-butadiene rubber (SBR), a chloroprene rubber (CR), a hydrin rubber (ECO, CO) and a urethane rubber. Particularly, the NBR is preferably used in terms of low hardness.

Specific examples of the silane coupling agent (B) include those having the following formulae (1) and (2):

$$Y1\text{-}C_3H_6Si(OC_nH_{2n+1})_3 \quad (1)$$

wherein Y1 is a vinyl group, a glycidoxy group, a mercapto group, an amino group, an epoxy group, an isocyanate group, a methacrylic group or their substituents including these functional groups; and n is 1 or 2;

$$Y2\text{-}Si(OC_2H_4OCH_3)_3 \quad (2)$$

wherein Y2 is a vinyl group.

Specific examples of the silane coupling agents having the formula (1) include γ-mercaptopropyltrimethoxysilane, γ-(methacryloxypropyl)trimethoxysilane, N-β(aminoethyl) γ-aminopropyltrimethoxysilane, γ-aminopropyltriethoxysilane, N-phenyl-γ-aminopropyltrimethoxysilane, bispropyltriethoxysilanetetrasulfide and propyltriethoxysilaneisocyanate. Specific examples of the silane coupling agents having the formula (2) preferably include vinyltris(βmethoxyethoxy)silane. These silane coupling agents can be used alone or in combination. Among these, γ-mercaptopropyltrimethoxysilane is more preferably used.

The coated layer 3 preferably includes the silane coupling agent (B) in an amount of from 0.01 to 15 parts by weight, and more preferably from 0.1 to 5 parts by weight per 100 parts by weight of the rubber material (A). When less than 0.01 parts by weight, the coated layer 3 is likely to peel. When greater than 15 parts by weight, the coated layer 3 is likely to have too high a hardness.

The rubber composition forming the coated layer 3 may include a conductivizer, a foamer, a cross-linker, a cross-linking promoter, an oil, etc. in addition to (A) and (B).

The coated layer 3 is formed with a coating liquid in which the above-mentioned layer constituent is dissolved in an organic solvent. The organic solvents include methylethylketone (MEK), methanol, toluene, isopropylalcohol, methylcellosolve, dimethylformamide, etc. These can be used alone in combination. Particularly, methylethylketone is preferably used in terms of its solubility of the above-mentioned layer constituent. The coating liquid preferably has a viscosity of from 0.005 to 6 Pa·s in terms of coatability. Coarse particles are dispersed in a predetermined amount in the coating liquid to prepare the coated layer 3 coating liquid.

The developing roller of the present invention can be prepared by, e.g., the following method.

First, the above-mentioned materials for forming the base rubber layer 2 are kneaded in a kneader to prepare a base rubber layer 2 constituent, and the base rubber layer 2 constituent is injected into a space between a metallic shaft and a cylinder. A cover is placed on the cylinder, and after the resultant roller mold is wholly heated to vulcanize the base rubber layer 2 constituent (150 to 220° C.×20 min), it is taken out to form the base rubber layer 2. An outer circumferential surface of the thus formed base rubber layer 2 is subjected to a corona discharge to activate.

The rubber material (A), the silane coupling agent (B), the coarse particles and the optional conductivizer are kneaded with an organic solvent in a kneader to prepare a coated layer 3 coating liquid.

Next, the coated layer 3 coating liquid is coated on the outer circumferential surface of the base rubber layer 2 subjected to a corona discharge. The coating method is not particularly limited, and known methods such as a dip coating method, a spray coating method and a roller coating method can be used. The coating liquid coated thereon is dried and heated to form the coated layer 3 on the outer circumferential surface of the base rubber layer 2. Thus, a double-layered developing roller as shown in FIG. 2 can be prepared. The base rubber layer 2 preferably has a thickness of from 0.5 to 10 mm, and more preferably from 1 to 5 mm. The coated layer 3 preferably has a thickness of from 3 to 10 μm, and more preferably from 5 to 7 μm. The coarse particles having a particle diameter about 10 μm are preferably used such that the coated layer 3 has a desired surface roughness.

In order to satisfy both of the durability and developability, the surface layer thickness and coarse particles are very important. The base rubber layer 2 may also be subjected to a plasma discharge to activate.

The developing roller is not limited to have a double-layered structure, and e.g., may further include a surface layer on an outer circumferential surface of the coated layer 3.

[Preparation of Base Rubber Layer Forming Material]

100 parts of a silicone rubber X-34-424 A/B from Shin-Etsu Chemical Co., Ltd. and 100 parts of a silicone rubber X-34-387 A/B from Shin-Etsu Chemical Co., Ltd. were mixed and dispersed to prepare a base rubber layer forming material.

[Preparation of Coated Layer Forming Material]

The following materials were mixed and dispersed to prepare a coated layer forming material.

| | |
|---|---|
| NBR (Nipol DN401 from ZEON CORP.) | 100 |
| γ-mercaptopropyltrimethoxysilane, (A-189 from Nippon Unicar Co., Ltd.) | 1 |
| Stearic acid (LUNAC S30 from Kao Corp.) | 0.5 |
| Zinc oxide (ZnO) | 5 |
| Acetylene black | 35 |
| Sanceler CZ-G (from Sanshin Chemical Industry Co., Ltd.) | 1.07 |
| Nocceler BZ-P (from Ouchi Shinko Chemical Industrial Co., Ltd.) | 0.49 |
| Powdered sulfur | 1 |
| Particulate silica having an average particle diameter of 10 μm | specified |

The particulate silica was used as coarse particles.

Next, a SUS303 metallic shaft 1 having a diameter of 10 mm, the outer circumferential surface of which is coated with an adhesive was set in a roller mold. The base rubber layer forming material was injected into a space between the shaft and an inner circumferential surface of the roller mold. After the base rubber layer forming material was vulcanized upon application of heat (180° C. for 1 hr), it was demolded and further vulcanized upon application of heat (200° C. for 4 hrs) to form a base rubber layer 2 having a thickness of 5 mm on an outer circumferential surface of the shaft 1. The thus prepared shaft including the base rubber layer was demolded, and an outer circumferential surface of the base rubber layer was subjected to a corona discharge with a high-frequency power unit at a distance of 3 mm from an electrode thereof and at an angle of 90° against the electrode for 10 sec. Then, a coating liquid including the coated layer forming material was coated on the outer circumferential surface of the base rubber layer, and dried and heated to form a double-layered coated layer 3 having a thickness of 5 μm on the base rubber layer 2.

The image developer and toner particles were evaluated in accordance with the following methods and standards. The results are shown in Tables 2-1 and 2-2.

<Toner Particle Diameter>

The average particle diameter and particle diameter distribution of the toner can be measured by a Coulter counter TA-II or Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The volume-average particle diameter (Dv) of a toner and number-average particle diameter (Dn) thereof can be measured based the distributions.

<Adherence Strength of External Additive>

After 2 g of the toner was put in 30 cc of a surfactant solution including a surfactant of 10% by weight and the surfactant is fully applied to the toner, an energy was applied to the toner with an ultrasonic homogenizer at 40 W for 1 min to separate the toner. Then, the toner was washed and dried. The adherent amounts of an inorganic particulate material before and after the toner was subjected to the surfactant were measured with a fluorescence X-ray spectrometer. A wavelength-dispersive fluorescence X-ray spectrometer XRF1700 from Shimadzu Corp. was used to determine an individual element such as silicon of silica by a calibration method from toner pellets prepared by applying a force of 1 N/cm$^2$ for 60 sec to 2 g of the toner before and after subjected to the surfactant.

<Toner Impedance>

3.0 g of the toner were pressurized at 6 MPa for 30 sec to form a pellet, and the pellet was placed in a cell for liquid (cell for measuring liquid TYPE 12964A from Toyo Technica Inc.) to measure the impedance while pressurized at 7.5N. A resistive component R2 was determined by fitting data of resistive component and capacitance component of each frequency while changing the frequency from 10 to 10,000 Hz at an AC voltage of 0.1 V.

Figure 3:
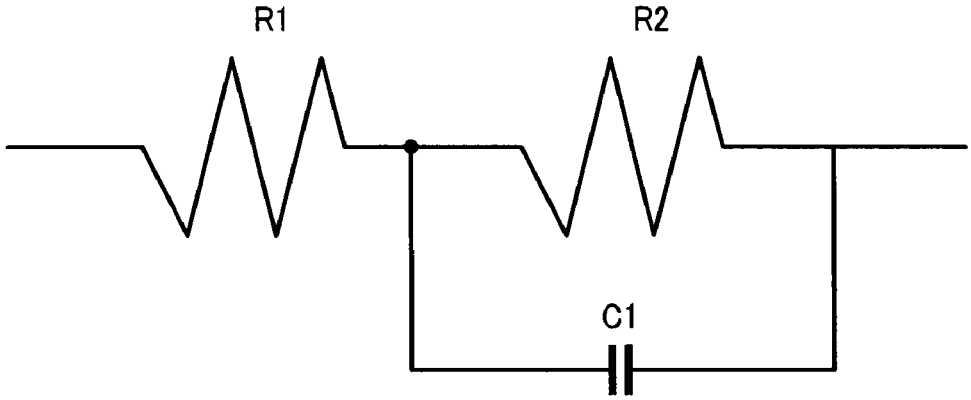
FIG. 3 is a schematic view illustrating an equivalent circuit used for measuring a toner impedance.

The analysis can be performed with a marketed software, and in the present invention, Zplot marketed by Toyo Technica Inc. was used to analyze, designating the equivalent circuit shown in FIG. 3.

FIG. 3 shows the equivalent circuit, in which R1 and R2 are resistive components and C1 is a capacitance component.

<Developing Roller Resistivity>

A DC voltage of 100 V was applied between the metallic shaft and surface layer of the developing roller, and a current value then was measured to determine the resistivity (voltage/current).

<Shape>

The shape of a toner is suitably measured by an optical detection method of passing a suspension liquid including a particle through a plate-shaped imaging detector to detect and analyze an image of the particle. A peripheral length of a circle having an area equivalent to that of a projected image optically detected is divided by an actual peripheral length of the toner particle to determine the circularity of a toner. A toner having an average circularity not less than 0.890, preferably of from 0.900 to 0.930, effectively produces images having appropriate density, reproducibility and high definition. Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

TABLE 2-1

| | | | | | | F3 | |
|---|---|---|---|---|---|---|---|
| | Log10R | Log10Z | F1 | F2 | F3 | left value | right value |
| Example 1 | 5.14 | 9.31 | ○ | ○ | ○ | 5.375 | 13.475 |
| Example 2 | 5.67 | 8.72 | ○ | ○ | ○ | 2.063 | 10.163 |

TABLE 2-1-continued

| | Log10R | Log10Z | F1 | F2 | F3 | F3 left value | F3 right value |
|---|---|---|---|---|---|---|---|
| Example 3 | 5.44 | 10.66 | ○ | ○ | ○ | 3.500 | 11.600 |
| Example 4 | 4.73 | 10.58 | ○ | ○ | ○ | 7.938 | 16.038 |
| Example 5 | 4.82 | 8.69 | ○ | ○ | ○ | 7.375 | 15.475 |
| Comparative Example 1 | 4.42 | 10.00 | X | ○ | ○ | 9.875 | 18.1 |
| Comparative Example 2 | 5.14 | 7.74 | ○ | X | ○ | 5.375 | 13.475 |
| Comparative Example 3 | 5.14 | 11.34 | ○ | X | ○ | 5.375 | 13.475 |
| Comparative Example 4 | 5.83 | 9.31 | X | ○ | X | 1.063 | 9.1625 |
| Comparative Example 5 | 5.69 | 10.55 | ○ | ○ | X | 1.938 | 10.038 |
| Comparative Example 6 | 4.71 | 8.01 | ○ | ○ | X | 8.063 | 16.163 |
| Comparative Example 7 | 5.67 | 8.72 | ○ | ○ | ○ | 2.063 | 10.163 |
| Comparative Example 8 | 5.67 | 8.72 | ○ | ○ | ○ | 2.063 | 10.163 |
| Comparative Example 9 | 5.67 | 8.72 | ○ | ○ | ○ | 2.063 | 10.163 |
| Comparative Example 10 | 5.67 | 8.72 | ○ | ○ | ○ | 2.063 | 10.163 |

F1: formula (1)
F2: formula (2)
F3: formula (3)

TABLE 2-2

| | SPD | AS | TPD | Cir | TQS | QW |
|---|---|---|---|---|---|---|
| Example 1 | 40 | 52 | 7.5 | 0.916 | 3.0 | 5.2 |
| Example 2 | 40 | 53 | 7.5 | 0.918 | 3.0 | 5.2 |
| Example 3 | 40 | 54 | 7.5 | 0.921 | 3.0 | 5.2 |
| Example 4 | 40 | 52 | 7.5 | 0.914 | 3.0 | 5.2 |
| Example 5 | 40 | 51 | 7.5 | 0.915 | 3.0 | 5.2 |
| Comparative Example 1 | 40 | 55 | 7.5 | 0.913 | 3.0 | 5.2 |
| Comparative Example 2 | 40 | 54 | 7.5 | 0.916 | 3.0 | 5.2 |
| Comparative Example 3 | 40 | 52 | 7.5 | 0.915 | 3.0 | 5.2 |
| Comparative Example 4 | 40 | 51 | 7.5 | 0.914 | 3.0 | 5.2 |
| Comparative Example 5 | 40 | 53 | 7.5 | 0.918 | 3.0 | 5.2 |
| Comparative Example 6 | 40 | 54 | 7.5 | 0.917 | 3.0 | 5.2 |
| Comparative Example 7 | 18 | 75 | 5.5 | 0.935 | 5.2 | 2.8 |
| Comparative Example 8 | 120 | 32 | 7.5 | 0.916 | 3.0 | 5.2 |
| Comparative Example 9 | 18 | 65 | 7.5 | 0.912 | 3.0 | 5.2 |
| Comparative Example 10 | 40 | 41 | 10.3 | 0.889 | 1.8 | 7.3 |

SPD: Silica (external additive) Particle Diameter
AS: Adherence Strength
TPD: Toner Particle Diameter
Cir: Circularity
TQS: Total Quantity of Silica
QW: Quantity of Wax <Image Evaluation>

Image evaluations were performed using color laser printer IPSIO CX2500 from Ricoh Company, Ltd.

[Halftone Image]

A halftone image was visually observed to see unevenness.

○: good

X: defect in quality

XX: fatal defect

[Contamination of Photoreceptor]

Contamination on the photoreceptor due to an external additive was visually observed.

○: good

X: defect in quality

XX: fatal defect

[Background Fouling]

Whiteness of a blank image was visually observed.

○: good

X: defect in quality

XX: fatal defect

The results are shown in Table 3.

TABLE 3

| | Halftone Image | Contamination of Photoreceptor | Background Fouling |
|---|---|---|---|
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | ○ |
| Comparative Example 1 | X | ○ | ○ |
| Comparative Example 2 | X | ○ | ○ |
| Comparative Example 3 | X | ○ | ○ |
| Comparative Example 4 | XX | ○ | X |
| Comparative Example 5 | X | ○ | X |
| Comparative Example 6 | XX | ○ | ○ |
| Comparative Example 7 | X | ○ | ○ |
| Comparative Example 8 | X | X | ○ |
| Comparative Example 9 | X | ○ | ○ |
| Comparative Example 10 | X | X | ○ |

This application claims priority and contains subject matter related to Japanese Patent Application No. 2007-067948 filed on Mar. 16, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image developer using a one-component developer, comprising:

a developing roller configured to visualize an electrostatic latent image formed on an image bearer with a pulverized toner; and a feed roller configured to feed the pulverized toner to the developing roller while contacting thereto, wherein the pulverized toner comprises:

a parent toner;

a wax; and an external additive comprising an additive having a number-average particle diameter of from 20 to 60 nm and adhering to the surface of the parent toner at an adherence strength of from 50 to 70%, and wherein the following relationships (1) to (3) are satisfied:

$$4.70<\mathrm{Log}_{10} R<5.70 \quad (1)$$

$$8.00<\mathrm{Log}_{10} Z<10.70 \quad (2)$$

$$-6.25*\mathrm{Log}_{10} R+37.5<\mathrm{Log}_{10} Z<-6.25*\mathrm{Log}_{10} R+45.6 \quad (3)$$

wherein R represents a resistivity of the developing roller and Z represents an impedance of the pulverized toner.

2. The image developer of claim 1, wherein the parent toner comprises a resin.

3. The image developer of claim 1, wherein the pulverized toner has a volume-average particle diameter of from 6 to 10 μm, and an average circularity of from 0.900 to 0.930.

4. The image developer of claim 1, wherein the external additive is silica included in the pulverized toner in an amount of from 2.0 to 5.0% by weight.

5. A process cartridge, comprising:

an image bearer configured to bear an electrostatic latent image;

an image developer configured to develop the electrostatic latent image; and at least one of a charger and a cleaner, wherein the image developer is the image developer according to claim 1.

6. An image forming apparatus, comprising:

a photoreceptor;

a charger configured to charge the photoreceptor to form an electrostatic latent image thereon;

an image developer configured to develop the electrostatic latent image with a developer comprising a toner to form a toner image on the photoreceptor;

a transferer configured to transfer the toner image onto a transfer sheet;

a fixer configured to fix the toner image on the transfer sheet; and a cleaner configured to clean the photoreceptor to remove the toner remaining thereon, wherein the image developer is the image developer according to claim 1.

7. The image forming apparatus of claim 6, wherein the fixer is an oilless fixer and the toner comprises the wax in an amount of from 3.0 to 7.0% by weight.

* * * * *